US008465687B2

(12) United States Patent
Häger

(10) Patent No.: US 8,465,687 B2
(45) Date of Patent: Jun. 18, 2013

(54) DEVICES AND METHODS OF MAKING HOLLOW CONCRETE ELEMENTS

(75) Inventor: Peter Häger, Djursholm (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 86 days.

(21) Appl. No.: 13/122,708

(22) PCT Filed: Oct. 8, 2008

(86) PCT No.: PCT/SE2008/051153

§ 371 (c)(1),
(2), (4) Date: Apr. 5, 2011

(87) PCT Pub. No.: WO2010/041995

PCT Pub. Date: Apr. 15, 2010

(65) Prior Publication Data

US 2011/0180966 A1 Jul. 28, 2011

(51) Int. Cl.

| | |
|---|---|
| ***B28B 3/18*** | (2006.01) |
| ***B28B 3/12*** | (2006.01) |
| ***B28B 1/20*** | (2006.01) |
| ***B28B 21/24*** | (2006.01) |

(52) U.S. Cl.
USPC ..... 264/312; 425/365; 425/366; 425/367; 264/333

(58) Field of Classification Search
USPC ..... 425/365, 366, 367; 264/312, 46.3, 264/333
See application file for complete search history.

(56) References Cited

U.S. PATENT DOCUMENTS

| | | | | |
|---|---|---|---|---|
| 1,750,748 | A | 3/1930 | Edmunds | |
| 3,435,648 | A * | 4/1969 | Bergstrom et al. | 72/1 |
| 3,577,505 | A * | 5/1971 | Ichihara | 264/256 |
| 3,585,694 | A * | 6/1971 | Baker et al. | 425/115 |
| 4,389,359 | A * | 6/1983 | Brunt et al. | 264/69 |
| 4,844,855 | A * | 7/1989 | Omori et al. | 264/311 |
| 5,470,599 | A * | 11/1995 | Ruhe | 426/231 |

FOREIGN PATENT DOCUMENTS

| | | |
|---|---|---|
| DE | 2444815 B1 | 3/1976 |
| FR | 655760 A | 4/1929 |
| GB | 445 790 | 4/1936 |
| WO | WO-98/36886 | 8/1998 |

OTHER PUBLICATIONS

Communication in Cases for Which No Other Form is Applicable, PCT Application No. PCT/SE2008/051153, May 28, 2010 (1 page).

(Continued)

*Primary Examiner* — Joseph S Del Sole
*Assistant Examiner* — Lawrence D Hohenbrink, Jr.
(74) *Attorney, Agent, or Firm* — Myers Bigel Sibley & Sajovec, P.A.

(57) ABSTRACT

Devices and methods for making hollow concrete elements are disclosed. A device includes a drum mold having a tubular mold wall. The mold wall has a first and a second end flange each with an inner periphery smaller than the inner periphery of the mold wall at each respective end. The device further includes a compaction roller positionable inside the mold wall. The compaction roller has a profile that defines the interior shape of the concrete element. The compaction roller is supported by a hydraulically height adjustable supporting mechanism that is operable to independently adjust the distance of each end of the compaction roller with respect to the inner periphery of the mold wall.

7 Claims, 3 Drawing Sheets

OTHER PUBLICATIONS

International Preliminary Report on Patentability, PCT Application No. PCT/SE2008/051153, Aug. 24, 2010 (8 pages).

Second and Supplementary Notice Informing the Applicant of the Communication of the International Application (To Designated Offices Which Apply the 30 Month Time Limit Under Article 22(1)), PCT Application No. PCT/SE2008/051153, Feb. 10, 2011 (1 page).

European Search Report Corresponding to European Patent Application No. 08877321.3; Dated: Jul. 27, 2012; 7 Pages.

Chinese Office Action Corresponding to Chinese Patent Application No. 200880131421; Issuing Date: Nov. 1, 2012; Foreign Text, 7 Pages, English Translation Thereof, 2 Pages.

* cited by examiner

DEVICES AND METHODS OF MAKING HOLLOW CONCRETE ELEMENTS

CROSS REFERENCE TO RELATED APPLICATION

This application is a 35 U.S.C. §371 national stage application of PCT International Application No. PCT/SE2008/051153, filed on 8 Oct. 2008, the disclosure of which is incorporated by reference herein in its entirety. The above-referenced PCT International Application was published in the English language as International Publication No. WO 2010/041995 A1 on 15 Apr. 2010.

TECHNICAL FIELD

The present invention relates to concrete elements and, in particular, to methods and devices for making hollow concrete elements.

BACKGROUND

Hollow concrete elements are used in various constructions, often as buried pipes, but also as constructional elements in buildings, bridges, towers, etc.

Elongated reinforced concrete structures are used in a variety of fields. Examples of elongated reinforced concrete structures include masts and towers, pylons, chimneys, architectural structures, straight and curved beams, etc.

Traditionally, such elongated structures are cast in moulds onsite, either in one single moulding or in a sequence of moulding steps wherein reinforcement elements moulded in a preceding moulding are integrated in the subsequent moulding to achieve a continuous or overlapping longitudinal reinforcement structure throughout the structure. However, onsite moulding is time- and labour-consuming, as well as requiring the transportation of moulding equipment to the site. Moreover it is difficult onsite to completely control all the parameters of the moulding process which means that the material properties of the finished structure are likely to be suboptimal. As a direct consequence of high risk that the final structure will suffer from suboptimal material properties, to ensure an adequate safety margin, the structures must be overdimensioned.

An alternative to onsite moulding is the prefabrication of elongated concrete segments that can be assembled onsite. As the prefabrication of segments can be performed under well-controlled conditions and the whole segment can be moulded in one integral moulding, many of the above disadvantages are avoided.

One method for making elongated concrete structures, such as pipes, known as the "Hume" method and described, for example, in U.S. Pat. No. 3,577,505 involves rotating a drum mould which has end flanges which extend towards the longitudinal axis of the mould by a placing it on a drive roller and a driven roller. In modern devices the driving force of a motor is transmitted to the drive roller to rotate said drum mould such that an acceleration of centrifugal force of normally 3 to 5 g or even up to 15 g is obtained at an inner periphery of the mould.

In this condition, concrete is cast or poured into the drum mould by means of a movable conveyor as the conveyor is inserted longitudinally into the mould through an opening formed in one of the edge flanges. The deposited concrete is intended to form a concrete layer of uniform thickness in the inner surface of the drum mould and is prevented from leaving the drum mould by the edge flanges. The motor output is raised to increase the rotation of the drum mould to such an extent that acceleration of the centrifugal force in the proximity of the inner surface of the drum mould is raised to a range of 20 to 50 g. As a result, water is squeezed out of the concrete layer to tighten or physically harden said concrete layer. The time required for this step depends on the thickness of the finished pipe, the consistency of concrete and the magnitude of the centrifugal force. In general, however, about 15 minutes are needed for the pipe of 500 m/m in diameter while 40 to 60 minutes are needed for that of 3 meters in diameter. These devices rely on centrifugal force to distribute the concrete, remove excess water from it and compact it. This leads to long process times. This is a wet casting system and the concrete, even if some water is lost during the process, is still very wet when it is being cured. This means that the concrete is liable to suffer from shrinkage cracks during curing and due to the high centrifugal force applied during the curing the concrete also will become heterogeneous. Hence, this method is only really suitable for underground pipes which are subjected to low stress.

Another relatively successful method of manufacturing open-ended hollow concrete elements in the form of concrete pipe sections is the roller suspension method—known as the "Rocla" method. This method involves suspending a pipe mould which has end flanges which extend towards the central longitudinal axis of the mould, on a rotatable compaction roller which is aligned parallel to the pipe axis. As the compaction roller rotates, the mould, which is arranged about and suspended by its end flanges on the compaction roller, rotates about the compaction roller. Earth dry concrete is fed into the interior of the mould as the mould rotates and, since the mould is suspended on the compaction roller, the concrete is compacted in the nip between the inner surface of the mould and the outer surface of the compaction roller resulting in a well-compacted concrete and a relatively smooth pipe of uniform thickness. This roller suspension method of pipe formation is well-known and therefore is not described herein in any greater detail. See for example publication WO9836886 A1 and GB1391763. However this method suffers from the disadvantage that compaction of the concrete by compression in the nip between the compaction roller and the interior of the mould only takes place once the thickness of the concrete in the mould is sufficiently deep such that it comes into contact with the compaction roller. This leads to long process and compaction times. Additionally the contact pressure between the compaction roller and the concrete can never be higher than the weight of the mould plus concrete distributed on the contact area. The contact pressure depends on the geometry of the pipe and the amount of concrete actually present in the pipe, and producing consistent products is dependent on the skill of the operator of the machine.

Patent documents FR2872843, EP1645701 and DE2939472 describe segmented elongated concrete structures in the form of towers for wind turbines, but they fail to describe efficient ways of producing such elements. PCTSE2007/050306 discloses a segmented tower structure and a method for producing such elements and a method for producing such towers.

Some of the problems with existing solutions and methods are that they are inefficient and require high cement and chemical content ratios or produce a lot of waste during casting or have long curing times and/or suffer from shrinkage and the subsequent formation of cracks.

SUMMARY

The object of the invention is to provide new methods and devices for making hollow concrete elements which overcome at least some of the drawbacks of the prior art. This is achieved by the method and device as defined in the independent claims. Further improvements are achieved by methods and devices having the features of the dependent claims.

The disclosed method of making an open-ended hollow concrete element comprising the steps of:

- arranging a mould about an essentially horizontal compaction roller, the mould comprising a tubular mould wall with an inner surface for defining the outer peripheral shape of the concrete element and a first and a second end flange each with an inner periphery smaller than the inner periphery of the mould wall at each respective end, said end flanges being provided for defining the end surfaces of the concrete element, the compaction roller being rotatably supported by height adjusting means able to independently adjust the distance of each end of the compaction roller with respect to the inner periphery of the mould wall so that the compaction roller upon rotation defines the inner peripheral shape of the concrete elements,
- rotating the mould,
- rotating the compaction roller,
- adjusting the height adjusting means to bring the said compaction roller into the proximity of the inner surface of the mould wall,
- feeding curable concrete to the interior of the rotating mould,
- moving said compaction roller away from the inner surface of the mould wall as the mould fills with concrete, said movement being made at a rate such that the compressive contact force between the surface of the concrete in the mould in contact with the surface compaction roller is maintained at a desired level or levels,
- allowing said curable concrete to cure,
- stopping the rotation of the mould,
- removing the cured concrete element from the mould,
- wherein the inner perimeter of the mould wall defines an exterior shape of the concrete element.

There is further provided a new device for making such open-ended hollow concrete elements, said device comprising a tubular mould wall defining the outer peripheral shape of the concrete element, said mould wall having a first and a second end flange each with an inner periphery smaller than the inner periphery of the mould wall at each respective end, said end flanges being provided for defining the end surfaces of the concrete element. The device further comprises a compaction roller positionable inside said mould wall, the roller having a profile which defines the interior shape of the concrete element and being supported by height adjusting means so that the distance of the compaction roller from the interior surface of the mould wall can be adjusted so that the compressive contact force between the concrete being fed into the mould and the surface of the compaction roller can be maintained at a desired level or levels of compressive force.

None of the mentioned prior art documents describe such a method or device.

The method and device for making open-ended hollow concrete elements has the following advantages over the prior art:

- Results in less porosity, higher concrete density and better durability.
- Makes it possible to cast concrete with low water-cement ratios.
- Provides high concrete strengths with low cement content.
- Allows a high speed of production, approx. 20 min per element.

Other embodiments of the invention are defined in the dependent claims.

DETAILED DESCRIPTION

Figure 1:
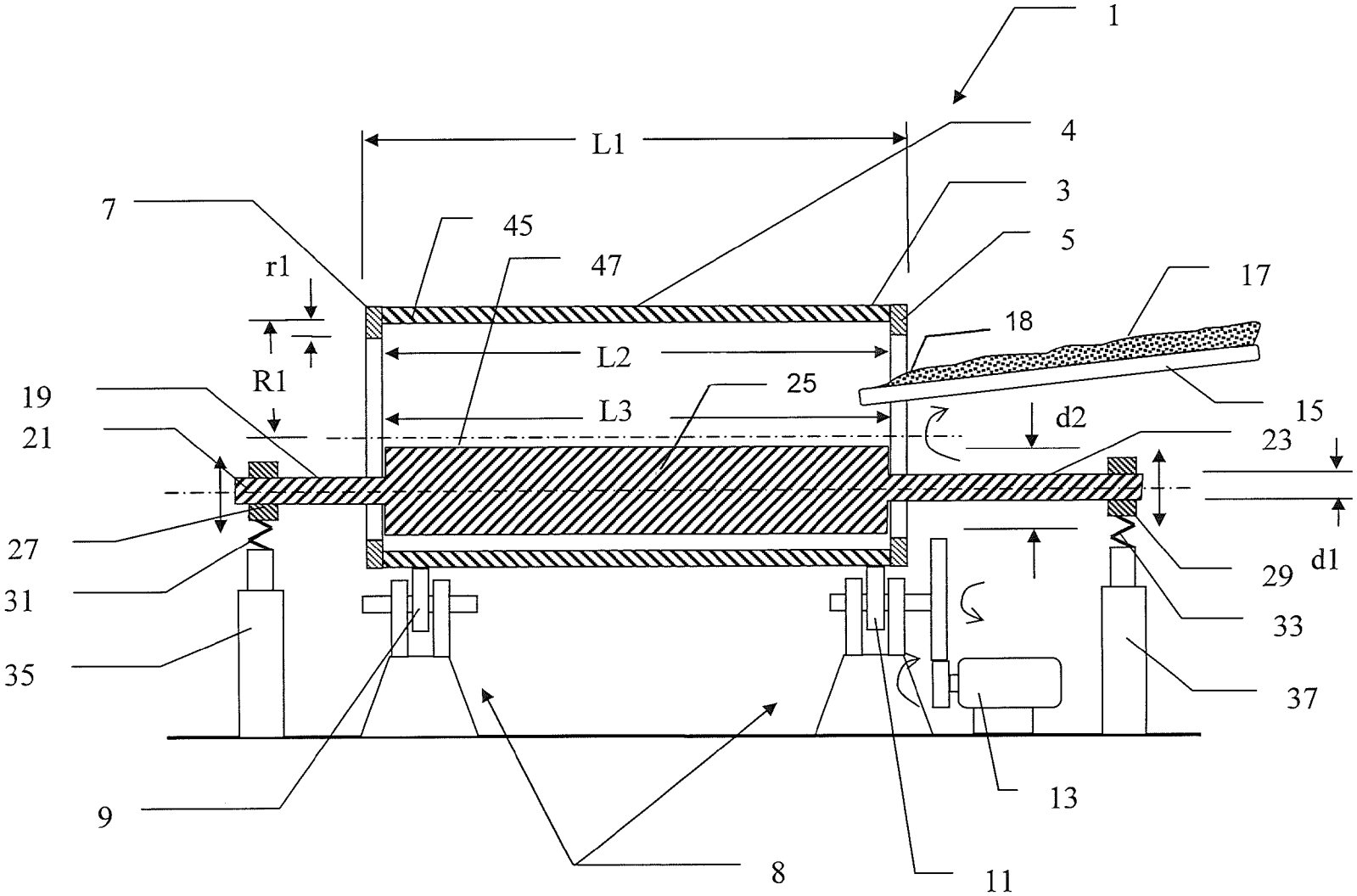
FIGS. 1 and 2 illustrate schematically a first embodiment of a device in accordance with the present invention for making n hollow elongated concrete element.
Figure 2:
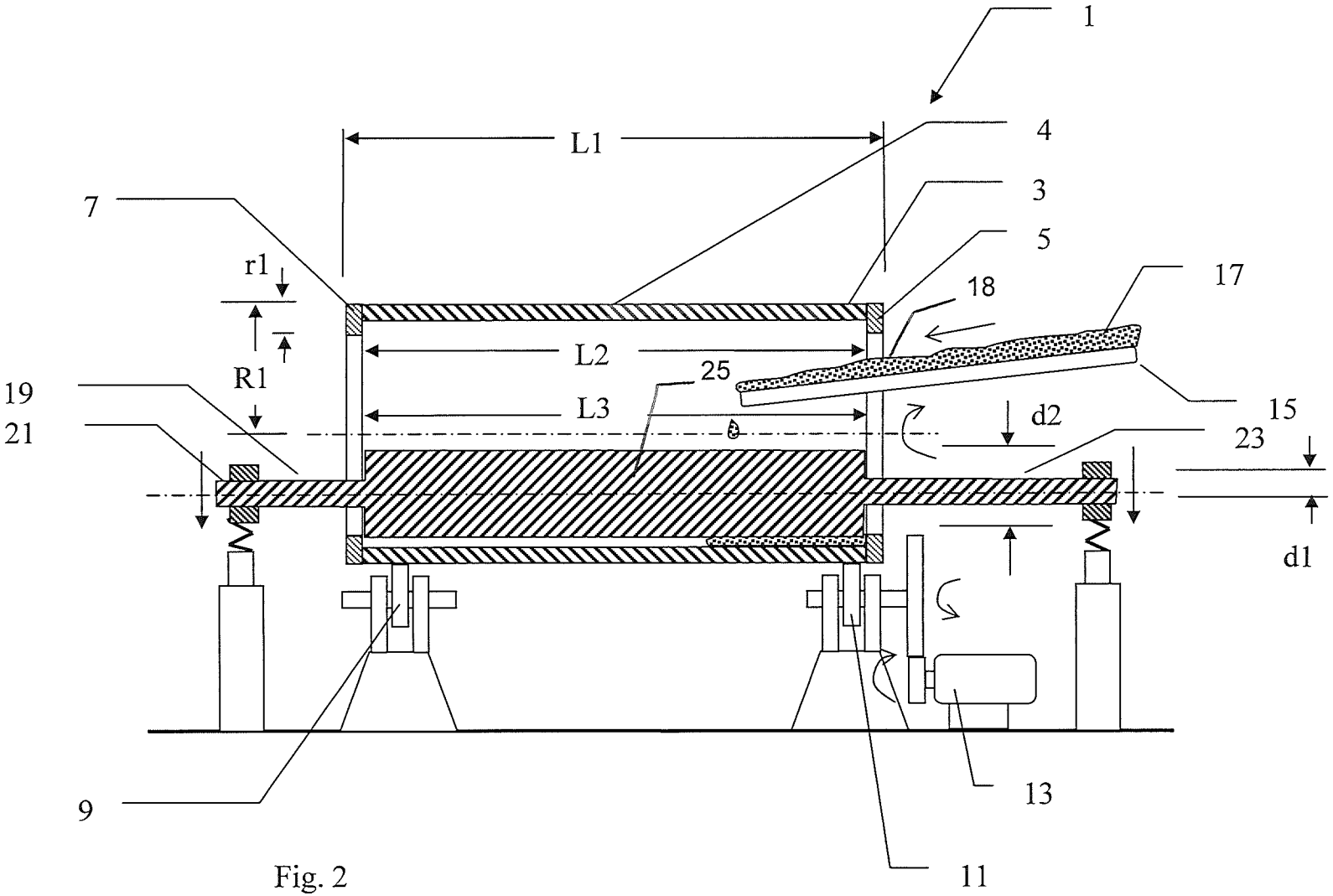

FIGS. 1 and 2 show a first embodiment in accordance with the present invention of an device for making a hollow elongated concrete element. The device 1 comprises a drum mould 3 which has a tubular wall 4 of internal radius R1 and length L1. Drum mould 3 has two concentrically-mounted end flanges 5, 7 which extend perpendicularly a distance r1 from the interior of the tubular wall towards the central longitudinal axis of the mould. The interior surfaces of end flanges 5, 7 are a distance L2 apart. The profile 45 of the drum mould is a straight line between the end flanges. The drum mould 3 is supported with its longitudinal axis substantially horizontal on a supporting frame 8 comprising a support and rotating means such as a drive roller 9 and a driven roller 11 or the like. The driving force of a drum mould rotating means such as motor 13 or the like is transmitted to the drive roller 8 to rotate said drum mould 3 such that an acceleration of centrifugal force greater than 1 g is obtained at all the inner periphery of the mould, thus forcing any concrete in the mould towards the interior surface of the mould. A longitudinally movable conveyor 15 supplied with wet concrete 17 from a supply of concrete (not shown) is arranged to be inserted longitudinally into the mould through an opening 18 formed in one of the edge flanges. During casting of a concrete element the concrete 17 is poured from the conveyor 15 as the conveyor moves longitudinally along the interior of the mould, thereby distributing the concrete substantially evenly along the length of the mould. In this embodiment the deposited concrete is intended to form a concrete layer of uniform thickness in the inner surface of the drum mould. The motor speed may be raised to increase the rotational speed of the drum mould to such an extent that acceleration of the centrifugal force in the proximity of the inner surface of the drum mould is raised to a level high enough to contribute to the desired compacting of the concrete. In order to aid the spreading of deposited concrete in the mould and to aid compaction of the deposited concrete the apparatus in accordance with the present invention is provided with a suspended compaction roller 19. In this embodiment of the invention the device is intended to make a hollow element of substantially constant diameter and with a wall thickness which is substantially constant along the length of the element. Compaction roller 19 is a longitudinally elongated stepped cylinder with a narrow first and a second end portion 21, 23 each of diameter d1 and a wider central portion 25 of diameter d2 where $(d1+(2\times r1))<d2$. The profile 47 of the central portion is a straight line. During use the central portion 25 is intended to be positioned in between and fit closely between end flanges and has a length L3 substantially the same as L2—the distance between the inner surfaces of end flanges 5, 7. As d2 is greater than $(d1+(2\times r1))$ when the surface of central portion 25 is in contact with the interior surface of drum mould there is no contact between the narrow first and second end portions 21, 23 of compaction roller 19 and the inwards-facing surfaces of end flanges 5, 7, thus preventing wear on the end flanges and first and second end portions 5, 7.

First and second narrow end portions 21, 23 of compaction roller 19 are each rotatably supported in height adjustable supporting means. As an example these can be arranged as follows. Each narrow end portion is supported in a respective bearing block 27, 29. Each bearing block is supported on a respective spring 31, 33 which is mounted on a respective hydraulic ram 35, 37. The hydraulic rams are each connected to a control system (not shown) which length of each ram to be independently adjusted. Adjustment of the length of each ram 35, 37 enables the end portions the compaction roller to be raised and lowered, thereby varying the distance between the surface of the central portion of compaction roller and the interior surface of the drum mould. This enables the force exerted by the compaction roller on concrete present in the mould to be varied. Moving the compaction roller closer to the interior surface of the drum mould, as shown schematically in FIG. 2, increases the compaction force on the concrete while moving it away decreases the compaction force. As the compaction roller extends substantially the whole distance between the inwards-facing surfaces of end flanges it is possible to exert substantially the same force over the whole of this distance and thereby achieve homogeneous compaction of the concrete. The desired level of compacting can be varied during the forming of an elongated concrete element by increasing or decreasing the speed of rotation of the mould and by increasing and decreasing the distance between the compaction roller and the interior surface of the mould.

Figure 3:
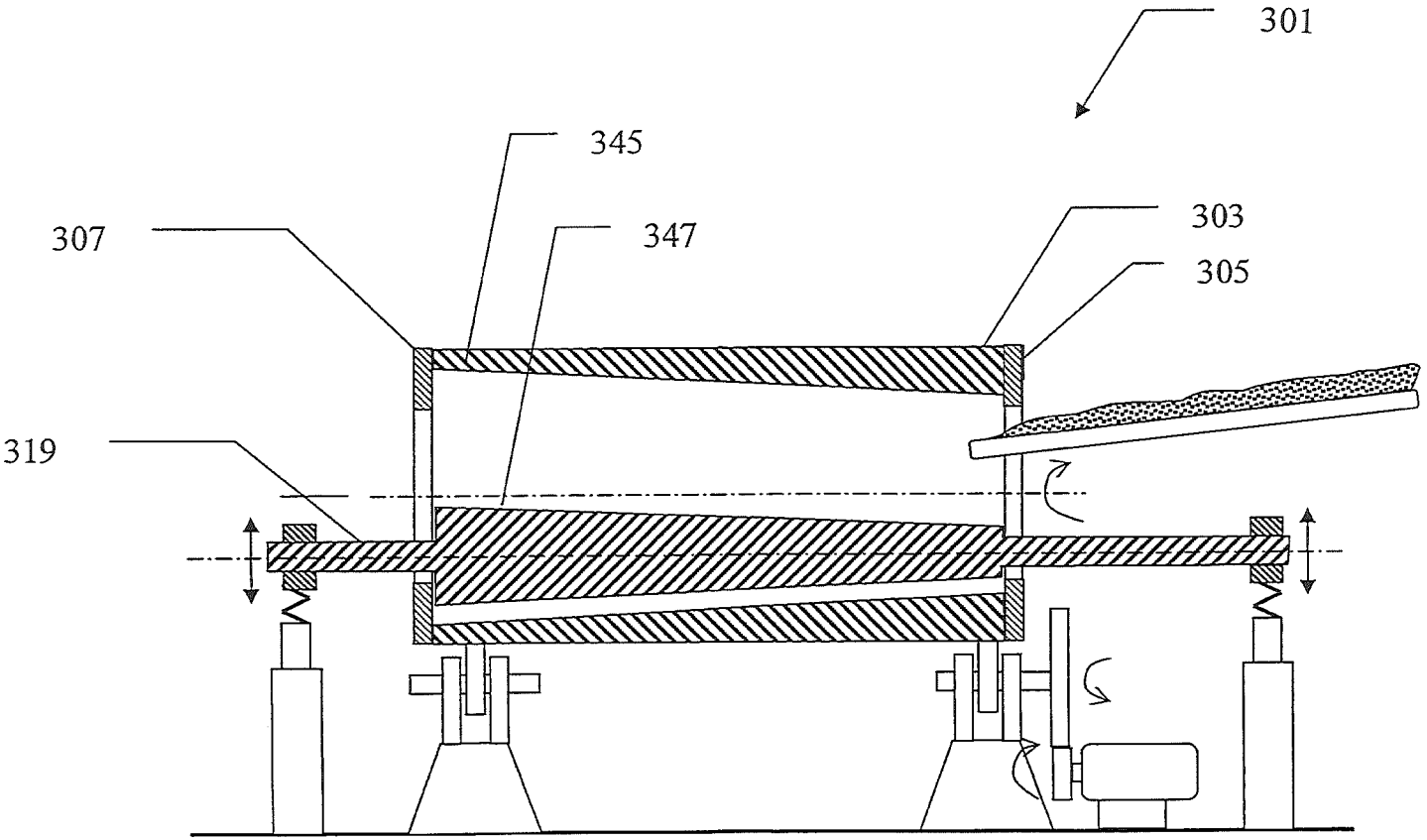
FIG. 3 illustrates schematically a second embodiment of a device in accordance with the present invention for making a hollow elongated concrete element.

FIG. 3 shows schematically a second embodiment of a device in accordance with the present invention. In this embodiment of the invention the device is intended to make a hollow element with a diameter which varies along the length of the element and has a wall thickness which is substantially constant along the length of the element. This device 301 comprising a elongated tubular mould wall 303 for defining the outer peripheral shape of the concrete element, said mould wall having a first and a second end flange 305, 307 each with an inner periphery smaller than the inner periphery of the mould wall at each respective end, said end flanges being provided for defining the end surfaces of the concrete element that is to be formed, wherein the inner profile 345 of the mould wall defines an exterior shape of the concrete element that varies along and/or radially to the direction of the rotational axis of the mould. The device further comprises a compaction roller 319 positionable inside said mould wall. The roller has a profile (in this case a tapered profile 347) which defines the interior shape of the concrete element and the roller is supported by height adjustable supporting means so that the distance of the compaction roller from the interior surface of the mould wall can be adjusted so that the compressive contact force between the concrete being fed into the mould and the surface of the compaction roller can be maintained at a desired level or levels of compressive force.

It conceivable that the inner diameter of the mould wall, that is its profile, varies along its length. The inner diameter of the mould wall defines the exterior shape, this is its profile, of the concrete element formed within it and thus said exterior shape that is its profile varies correspondingly along the direction of the rotational axis of the mould e.g. is curved, tapered or locally projects inwardly or outwardly. In this case the compaction roller can also have an exterior shape, i.e. its profile, which varies along its rotational axis, thus making the interior surface of the concrete element vary correspondingly. It is not necessary that the exterior shape of the compaction roller and the interior shape of the drum mould are complementary—non-complementary shapes allow for local thickening or thinning of the concrete element and the formation of grooves or steps in its wall thickness.

In each embodiment of the present invention it is preferable that the ends of the compaction roller can be moved independently. This allows the distance of each end of the compaction roller from the inner surface of the drum mould to be independently adjusted which means that if one end of the compaction roller is at a different distance from the inner surface than the other it is possible to vary the thickness of the walls of the concrete element along its length.

While the invention has been described with reference to specific exemplary embodiments, the description is in general only intended to illustrate the inventive concept and should not be taken as limiting the scope of the invention.

It will be understood by those skilled in the art that various modifications and changes may be made to the present invention without departure from the scope thereof, which is defined by the appended claims.

The invention claimed is:

1. A device for making a hollow concrete element comprising:

a drum mould having a tubular mould wall, the mould wall having a first and a second end flange each with an inner periphery smaller than an inner periphery of the mould wall at each respective end;

a compaction roller positionable inside the mould wall, the compaction roller having a profile that defines an interior shape of the concrete element, the compaction roller being supported by hydraulically height adjustable supporting means to independently adjust a distance of each end of the compaction roller with respect to the inner periphery of the mould wall, such that the ends of the compaction roller are positionable at differing locations between the inner periphery of the first and second flanges, respectively, and the inner periphery of the mould wall.

2. A device according to claim 1, wherein the compaction roller comprises a first narrow end portion and a second narrow end portion, each of the first and second narrow end portions being rotatably supported in a respective bearing block, each of the bearing blocks being supported on a respective spring mounted on a respective hydraulic ram.

3. A device in accordance with claim 1, wherein a profile of the compaction roller and a profile of an interior of the drum mould are complementary.

4. A device in accordance with claim 1, a profile of the compaction roller and a profile of an interior of the drum mould are not complementary.

5. A method of making an open-ended hollow concrete element comprising:

arranging a drum mould about a compaction roller, the drum mould comprising a tubular mould wall with an inner surface for defining an outer peripheral shape of the concrete element and a first and a second end flange each with an inner periphery smaller than an inner periphery of the mould wall at each respective end;

providing the compaction roller with hydraulically height adjustable supporting means to independently adjust a distance of each end of the compaction roller with respect to the inner periphery of the mould wall, such that the ends of the compaction roller are positionable at differing locations between the inner periphery of the first and second flanges, respectively, and the inner periphery of the mould wall;

rotating the drum mould;

hydraulically adjusting the height adjustable supporting means to bring the compaction roller into proximity with the inner surface of the mould wall, feeding curable concrete to an interior of the rotating drum mould;

moving the compaction roller away from the inner surface of the mould wall as the drum mould fills with curable concrete at a rate such that compressive contact force between a surface of the curable concrete in the drum mould in contact with a surface of the compaction roller is maintained at a desired level;

allowing the curable concrete to at least partially cure;

stopping the rotation of the drum mould; and removing the cured concrete from the drum mould.

6. A method in accordance with claim 5 wherein a profile of the compaction roller and a profile of an interior of the drum mould are complementary.

7. A method in accordance with claim 5 wherein a profile of the compaction roller and a profile of an interior of the drum mould are not complementary.

* * * * *